US007240983B2

(12) United States Patent
Kojima

(10) Patent No.: US 7,240,983 B2
(45) Date of Patent: Jul. 10, 2007

(54) INKJET RECORDING APPARATUS AND PRELIMINARY DISCHARGE CONTROL METHOD

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 345 days.

(21) Appl. No.: 10/941,853

(22) Filed: Sep. 16, 2004

(65) Prior Publication Data

US 2005/0062792 A1 Mar. 24, 2005

(30) Foreign Application Priority Data

Sep. 18, 2003 (JP) ..... 2003-325613

(51) Int. Cl.
*B41J 2/165* (2006.01)

(52) U.S. Cl. ..... 347/23; 347/29; 347/30; 347/32; 347/33; 347/35

(58) Field of Classification Search ..... 347/22–35
See application file for complete search history.

(56) References Cited

U.S. PATENT DOCUMENTS 5,406,317 A * 4/1995 Shimamura et al. ..... 347/23
5,475,404 A 12/1995 Takahashi et al.
6,796,633 B1 * 9/2004 Kawamata et al. ..... 347/23
6,808,247 B2 * 10/2004 Kawatoko et al. ..... 347/23
2003/0025745 A1 2/2003 Kawatoko et al.

FOREIGN PATENT DOCUMENTS

JP 11-192729 A 7/1999
JP 2002-361910 A 12/2002

* cited by examiner

*Primary Examiner*—Shih-Wen Hsieh
(74) *Attorney, Agent, or Firm*—Birch, Stewart, Kolasch & Birch, LLP

(57) ABSTRACT

The inkjet recording apparatus comprises: a recording head including nozzles which discharge ink droplets onto a recording medium for printing; a computing device which computes a non-operational time period for one of the nozzles; a calculating device which calculates a predicted non-operational time period until a next operation of the one of the nozzles; and a preliminary discharge control device which performs control whereby preliminary discharge of the one of the nozzles is carried out if a total of the non-operational time period and the predicted non-operational time period exceeds a reference time period.

16 Claims, 14 Drawing Sheets

INKJET RECORDING APPARATUS AND PRELIMINARY DISCHARGE CONTROL METHOD

This Non-provisional application claims priority under 35 U.S.C. § 119(a) on Patent Application No(s). 2003-325613 filed in Japan on Sept. 18, 2003, the entire contents of which are hereby incorporated by reference.

BACKGROUND OF THE INVENTION

1. Field of the Invention

The present invention relates to an inkjet recording apparatus and a preliminary discharge control method, and in particular, to technology for controlling a recovery operation of a recording head.

2. Description of the Related Art

Recently, inkjet recording apparatuses (inkjet printers) have become common as recording apparatuses for printing and recording images captured by digital still cameras, and the like. An inkjet recording apparatus comprises a plurality of recording elements in a head, the recording head being moved to scan a recording medium while droplets of ink are discharged onto the recording medium from the recording elements, and each time one line of an image is recorded onto recording paper, the recording medium is conveyed through a distance corresponding to one line, this process being repeated, whereby an image is formed onto the recording paper.

Inkjet printers include those which use a short-length serial head, and carry out recording by causing the head to scan in the lateral direction of a recording medium, and those which use a line head in which recording elements are aligned up to a dimension corresponding to the full width of one edge of the recording medium. In a printer using a line head, it is possible to carry out image recording across the full surface of the recording medium, by scanning the recording medium in an orthogonal direction to the direction in which the recording elements are arranged. In a printer using a line head, it is not necessary to provide a conveyance system, such as a carriage, or the like, for causing a short-dimension head to scan, and furthermore, movement of the carriage and complex scanning control of the recording medium also becomes unnecessary. Furthermore, since only the recording medium is moved, it is possible to achieve higher recording speeds in comparison to printers using serial heads.

Inks used in inkjet printers have a characteristic in that when they come into contact with the atmosphere, the ink solvent (principally water in the case of water-based inks, for example), evaporates, and the viscosity of the ink increases gradually as time passes, until eventually, it solidifies. Therefore, at nozzles which have not discharged ink for a long period of time, firstly, the ink in the peripheral region of the nozzle opening (the surface where the ink comes into contact with the air) becomes highly viscose, and gradually, the ink inside the nozzle also increases in viscosity.

If increased viscosity of the ink occurs as described above, then the ink becomes less liable to be discharged from a nozzle which has not discharged ink for a long period of time, and furthermore, a problem arises in that as time passes, it will become impossible to discharge the ink, even if the prescribed pressure is applied.

In order to resolve problems of this kind, preliminary discharge (purge, liquid discharge, air discharge, dummy discharge) is carried out at prescribed time intervals, and a recovery operation is implemented whereby the ink of increased viscosity inside the nozzles is discharged externally, or hardened ink is sucked in by means of a suctioning device, such as a pump.

In the inkjet recording apparatus, recovery processing method and storage medium storing a recovering processing program disclosed in Japanese Patent Application Publication No. 11-192729, the nozzles used in printing the same content are established, and therefore, it is not necessary to perform recovery operation during printing, and control is performed in such a manner that a recovery operation is not carried out during recording, if a plurality of prints of the same content are being made. If, on the other hand, the print contents are different, then the time that each nozzle is left unused is recorded, and if it is equal to or below a reference time, then control is implemented in such a manner that a recovery operation is not carried out for that nozzle. By performing control in this way, the number of preliminary discharge operations is reduced and the amount of ink consumed is also reduced.

However, if a recovery operation is carried out frequently in order to prevent discharge errors or discharge failures, then not only does this increase the amount of ink consumed, but furthermore, it also causes the productivity of the actual printing process to fall. Moreover, since a recovery device for performing a recovery operation includes consumables parts, such as a blade, or the like, then it is necessary to carry out maintenance of these consumable parts.

In the inkjet recording apparatus, the recovery processing method and the storage medium storing a recovery processing program disclosed in Japanese Patent Application Publication No. 11-192729, even in the case of prints of the same content, if a large volume of prints are made at any one time, then any nozzles not used in that print will be unused for a long period of time, and hence the ink inside the nozzles may solidify completely (the viscosity thereof may become extremely high or the viscosity may increase from the nozzle opening section and through to the deeper regions of the nozzle), and it may not be possible to recover the nozzle simply by performing preliminary discharge. Considering the case of a print having long dimensions, if the time out of use is checked before printing, then increase in the viscosity of the ink will occur during printing, and the reference time period until discharge errors arise may be exceeded.

Consequently, discharge errors or discharge failures may occur at the nozzles, and hence, in the print result, streaking may arise in the direction of conveyance of the recorded medium. The aforementioned problem is particularly noticeable in the case of single-pass printing using a line head.

SUMMARY OF THE INVENTION

The present invention has been contrived in view of such circumstances, and an object thereof is to provide an inkjet recording apparatus and a preliminary discharge control method whereby recovery of nozzles can be performed reliably, while at the same time, the amount of ink consumed in the recovery operation can be reduced.

In order to attain the above-described object, the present invention is directed to an inkjet recording apparatus, comprising: a recording head including nozzles which discharge ink droplets onto a recording medium for printing; a computing device which computes a non-operational time period for one of the nozzles; a calculating device which calculates a predicted non-operational time period until a next operation of the one of the nozzles; and a preliminary discharge control device which performs control whereby preliminary discharge of the one of the nozzles is carried out if a total of the non-operational time period and the predicted non-operational time period exceeds a reference time period.

More specifically, control is performed whereby preliminary discharge is carried out, if the total time period of the non-operational time period (past portion) from the previous operation of the nozzle, plus the predicted time period from the current time until the next time that the nozzle is to be operated, exceeds a reference time period. Therefore, it is possible to prevent the occurrence of discharge abnormalities in the nozzles, during the course of printing.

Operation of the nozzle also includes, in addition to discharge of the ink during printing, recovery operations, such as preliminary discharge, nozzle suctioning, and the like.

If the ink is expelled (discharged) from a nozzle due to the operation of the nozzle, preliminary discharge thereof, suctioning, or the like, then the calculated non-operational time period is reset (initialized), and a new non-operational time period is measured after the reset.

The interval time period between images and the time period required for margin regions may also be included in the non-operational time period.

The timing at which a judgment is made regarding whether or not preliminary discharge is to be carried out may be when printing of each image starts, or it may be when printing of each batch (printing job) starts. Moreover, if the judgment is made on a batch-by-batch basis, then in the case of a batch that takes a long time, it is possible to implement control in such a manner that the judgment is made for each image in the batches, or at any desired timing, or the like.

The recording head may be a full line type print head wherein ink discharge ports (nozzle opening) are disposed along the entire printable region of the recording medium which is to be printed, in a direction substantially orthogonal to the direction of conveyance of the recording medium, or it may be a divided type head wherein a line type print head is divided up into a plurality of heads. Furthermore, it is also possible to use a shuttle scan type print head wherein a short-dimension print head causes ink droplets to be discharged, while moving in a direction substantially orthogonal to the conveyance direction of the print medium. A combination of a line type head and a shuttle scan type head may also be used.

During printing, or during standby, if the use frequency of a particular nozzle is low, and if it continues in a state of not discharging ink for a prescribed time period or more, then the solvent in the ink in the vicinity of the nozzle evaporates and the viscosity of the ink increases. In a situation of this kind, it will become impossible to discharge ink from the nozzle, even if the actuator is operated.

Preliminary discharge (purging, "spit" discharge, blank discharge, dummy discharge) is a discharge of the ink inside a nozzle, which is carried out before a situation of this kind develops (while the ink is of a viscosity that allows discharged by means of operation of the actuator), by operating the actuator and expelling the degraded ink (the ink in the vicinity of the nozzle having increased viscosity), and it may be carried out whenever the power supply is switched on (or reset), and at prescribed time intervals, or it may be carried out as and when necessary, by detecting the results of droplet ejection.

The reference time period may be set for each nozzle, or it may be set for each plurality of nozzles. Moreover, it may also be set for the whole recording head. Furthermore, if a plurality of recording heads are provided, then it may be set individually for each recording head, or it may be set universally for all of the heads.

In the present specification, the term "printing" indicates the concept of forming images in a broad sense, including text, and not simply the formation of text.

Moreover, in order to attain the above-described object, the present invention is also directed to an inkjet recording apparatus, comprising: a recording head including nozzles which discharge ink droplets onto a recording medium for printing; a computing device which computes a non-operational time period for the nozzles; a calculating device which calculates a predicted non-operational time period until a next operation of the nozzles; and a preliminary discharge control device which performs control whereby: in one of the nozzles to be operated in a next image, preliminary discharge of the nozzle is carried out if a total of the non-operational time period and the predicted non-operational time period exceeds a first reference time period; and in one of the nozzles not to be operated in the next image, a prescribed time period is set as the predicted non-operational time period, and preliminary discharge of the nozzle is carried out if a total of the non-operational time period and the prescribed time period exceeds a second reference time period.

More specifically, it is judged whether or not to carry out preliminary discharge on the basis of the first reference time period, in the case of a nozzle that is to be operated, and on the basis of the second reference time period, in the case of a nozzle that is not to be operated. The necessity of preliminary discharge can be judged according to whether or not a nozzle is to be operated, and hence the amount of ink consumed in preliminary discharge can be reduced.

If two reference time periods are used, in such a manner that the first reference time period is shorter than the second reference time period, then it is possible to reduce the number of preliminary discharge operations in nozzles that are not to be operated, in comparison with nozzles which are to be operated.

The first reference time period and the second reference time period may be set respectively for each nozzle, or they may be set for each plurality of nozzles. Moreover, they may also be set for the whole recording head. Furthermore, if a plurality of recording heads are provided, then they may be set individually for each recording head, or they may be set universally for all of the heads.

Since the predicted non-operational time cannot be calculated in a nozzle that is not to be operated, a prescribed time period (value) is set instead of a predicted non-operational time. This prescribed time period may be zero, or it may be a value determined by prescribed calculation. The mode for determining the prescribed time period may be based on the average value of the non-operational times in the past, or it may be based on a predicted value obtained by predicting the non-operational time period on the basis of the past history. Furthermore, if the prescribed time period to be zero, then it is judged whether or not to carry out preliminary discharge on the basis of the non-operational time only.

Furthermore, in order to attain the above-described object, the present invention is also directed to an inkjet recording apparatus, comprising: a recording head including nozzles which discharge ink droplets onto a recording medium for printing; a computing device which computes a non-operational time period for the nozzle; a calculating device which calculates a predicted non-operational time period until a next operation of the nozzle; and a preliminary discharge control device which performs control whereby: in one of the nozzles to be operated in a next image, preliminary discharge of the nozzle is carried out when a total of the non-operational time period and the predicted non-operational time period exceeds a first reference time period; and in one of the nozzles not to be operated in the next image, preliminary discharge of the nozzle is carried out when a total of the non-operational time period and a time period from a current time until printing of a trailing end portion of the next image has completed, exceeds a second reference time period.

In other words, since control is performed whereby, in a nozzle that is to be operated in the next image, preliminary discharge is carried out if the total of the non-operational time period since the last operation of that nozzle and the predicted time period until the nozzle is next operated exceeds the first reference time period, and in a nozzle that is not to be operated in the next image, preliminary discharge is carried out, if the total of the non-operational time period and the time period until printing of the trailing end portion of the next image has completed, exceeds the second reference time period, then this means that the necessity of preliminary discharge is judged in accordance with the operational or non-operational status of the nozzle according to the print contents, and furthermore, a plurality of reference time periods are provided according to the operational or non-operational status of the nozzle, and it is controlled whether or not to carry out preliminary discharge on the basis of these reference time periods. Consequently, it is possible to reduce the number of preliminary discharge operations, and furthermore, the ink consumed due to preliminary discharge can also be reduced.

Preferably, the preliminary discharge control device performs control in a case where a plurality of prints of a same image are to be executed whereby: in one of the nozzles to be operated, preliminary discharge of the nozzle is carried out when a first one of the plurality of prints is executed if the total of the non-operational time period and the predicted non-operational time period exceeds the first reference time period; and in one of the nozzles not to be operated, preliminary discharge of the nozzle is carried out when each of the plurality of prints is executed if a total of the non-operational time period and a time period until printing of a trailing end portion of the next print is completed exceeds the second reference time period during printing of the next print.

More specifically, since preliminary discharge is prevented from being carried out frequently during actual printing, it is possible to print desirable images, without impairing productivity, and furthermore, the amount of ink consumed due to preliminary discharge can also be reduced.

For example, the reference time period and the first reference time period can be a time period until discharge abnormality in the ink-droplets discharged from the nozzles occurs.

A discharge abnormality may be a discharge volume abnormality wherein ink of a different amount to the intended amount of ink is discharged, or a discharge direction abnormality wherein ink is discharged in a direction that differs from the intended discharge direction. Moreover, the occurrence of splashes, or the like, is also included in discharge abnormalities. When discharge abnormalities of this kind occur, then this readily leads to a decline in the quality of the printing results.

It can be judged whether or not discharge abnormalities have arisen by considering variation in ink discharge, and the direction of discharge.

For example, the second reference time period can be a time period until discharge failure occurs whereby ink is not discharged from the nozzles by prescribed driving.

A discharge error may be a state where the ink cannot be discharged, even if the prescribed pressure is applied to the ink, or it may be a state where the ink cannot be discharged, even if the maximum pressure that can be output by the drive source (actuator) supplying pressure to the ink is applied to the ink.

Since nozzles which have developed discharge failure cannot be recovered by preliminary discharge, a recovery operation, such as suctioning by means of a pump, or the like, is performed. It is necessary to carry out preliminary discharge before a discharge failure develops, in other words, while the nozzle can still be recovered by means of preliminary discharge.

Preferably, each of the reference time period, the first reference time period and the second reference time period is determined in accordance with at least one of a type of ink and use environmental conditions of the recording head.

Types of ink include dye based inks and pigment based inks, and the like, and the constituents vary depending on the type of ink, which means that the time until viscosity starts to increase and the rate of advance of viscosity increase also varies. Furthermore, the time until viscosity starts to increase and the rate of advance of viscosity increase vary depending on the use environmental conditions, such as the use temperature, humidity, and the like.

If the time at which the viscosity starts to increase becomes earlier, or the rate of advance of the viscosity increased becomes quicker, then the reference time period, and the first reference time period and the second reference time period should be set to shorter times than normal.

Furthermore, the present invention also provides methods for attaining the aforementioned object. More specifically, the present invention is also directed to a preliminary discharge control method for an inkjet recording apparatus comprising a recording head including nozzles which discharge ink droplets onto a recording medium for printing, the method comprising: a computing step of computing a non-operational time period for one of the nozzles; a calculating step of calculating a predicted non-operational time period until a next operation of the one of the nozzles; and a preliminary discharge step of carrying out preliminary discharge of the one of the nozzles, by means of a preliminary discharge control device which controls preliminary discharge, if a total of the non-operational time period computed in the computing step and the predicted non-operational time period calculated in the calculating step, exceeds a reference time period.

Preferably, a determining step is provided for determining nozzles that are to be operated next, and nozzles that are not to be operated next, control being implemented whereby, in a nozzle that is to be operated next, preliminary discharge of the nozzle is carried out in the preliminary discharge step, if the total of the non-operational time period and the predicted non-operational time period exceeds a first reference time period, and in a nozzle that is not to be operated next, preliminary discharge of the nozzle is carried out in the preliminary discharge step, if the total of the non-operational time period and the time period until the trailing end portion of the next image is printed exceeds a second reference time period.

The relationship between the first reference time period and the second reference time period is such that the first reference time period is less than the second reference time period.

Moreover, in order to attain the above-described object, the present invention is also directed to a preliminary discharge control method for an inkjet recording apparatus comprising a recording head including nozzles which discharge ink droplets onto a recording medium for printing, the method comprising: a computing step of computing a non-operational time period for one of the nozzles; a calculating step of calculating a predicted non-operational time period until a next operation of the one of the nozzles; and a preliminary discharge step of carrying out preliminary discharge by means of a preliminary discharge control device for controlling preliminary discharge whereby: in one of the nozzles to be operated in a next image, preliminary discharge of the nozzle is carried out if a total of the non-operational time period and the predicted non-operational time period exceeds a first reference time period; and in one of the nozzles not to be operated in the next image, a prescribed time period is set as the predicted non-operational time period, and preliminary discharge of the nozzle is carried out if a total of the non-operational time period and the prescribed time period exceeds a second reference time period.

More specifically, since a preliminary discharge reference is provided even for nozzles which are not to be operated in the next printing operation, then preliminary discharge can be carried out at a preferable timing.

Furthermore, in order to attain the aforementioned object, the present invention is also directed to a preliminary discharge control method for an inkjet recording apparatus comprising a recording head including nozzles which discharge ink droplets onto a recording medium for printing, the method comprising: a computing step of computing a non-operational time period for one of the nozzles; a calculating step of calculating a predicted non-operational time period until a next operation of the one of the nozzles; and a preliminary discharge step of carrying out preliminary discharge by means of a preliminary discharge control device for controlling preliminary discharge whereby: in one of the nozzles to be operated in a next image, preliminary discharge of the nozzle is carried out when a total of the non-operational time period and the predicted non-operational time period exceeds a first reference time period; and in one of the nozzles not to be operated in the next image, preliminary discharge of the nozzle is carried out when a total of the non-operational time period and a time period from a current time until printing of a trailing end portion of the next image has completed, exceeds a second reference time period.

More specifically, preliminary discharge can be performed reliably even in nozzles which are not to be operated in the next printing operation.

According to the present invention, since control is performed in such a manner that it is judged whether or not to carry out preliminary discharge on the basis of the total of the non-operational time from the last time that a nozzle was operated until the current time, plus the predicted non-operational time from the current time until the nozzle is next to be operated, then discharge errors can be prevented from occurring in operating nozzles during the course of printing.

Moreover, two parameters are provided for the reference time periods for carrying out preliminary discharge, and these reference time periods can be used selectively, for nozzles which are to be operated in the next image, and for nozzles which are not to be operated in the next image. Therefore, it is possible to reduce the number of preliminary discharge operations, and hence the amount of ink consumed by preliminary discharge can be reduced. In the prior art, preliminary discharge has been controlled with respect to the first reference (discharge abnormality) of the present invention, and therefore, it has not been possible to reduce ink consumption.

When printing a plurality of images of the same content, since the nozzles that are to be operated and the nozzles that are not to be operated are determined, then in the case of the nozzles that are to be operated, it is judged whether or not to carry out preliminary discharge when the first copy is printed, and in the case of the nozzles that are not to be operated, it is judged whether or not to carry out preliminary discharge when each copy is printed. Therefore, the number of preliminary discharge operations can be reduced, and discharge errors and discharge failures can be avoided.

Preferably, one of the two reference time periods is taken to be the time period until discharge abnormality (a state where ink is discharged but is not discharged normally) arises, and the other thereof is taken to be the time period until discharge failure (a state where ink cannot be discharged from a nozzle until normal control conditions) arises.

Preferably, the reference time periods for carrying out preliminary discharge are determined in such a manner that they are optimized for respective ink types, ink colors, and use conditions (temperature, humidity, atmospheric pressure, and the like).

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
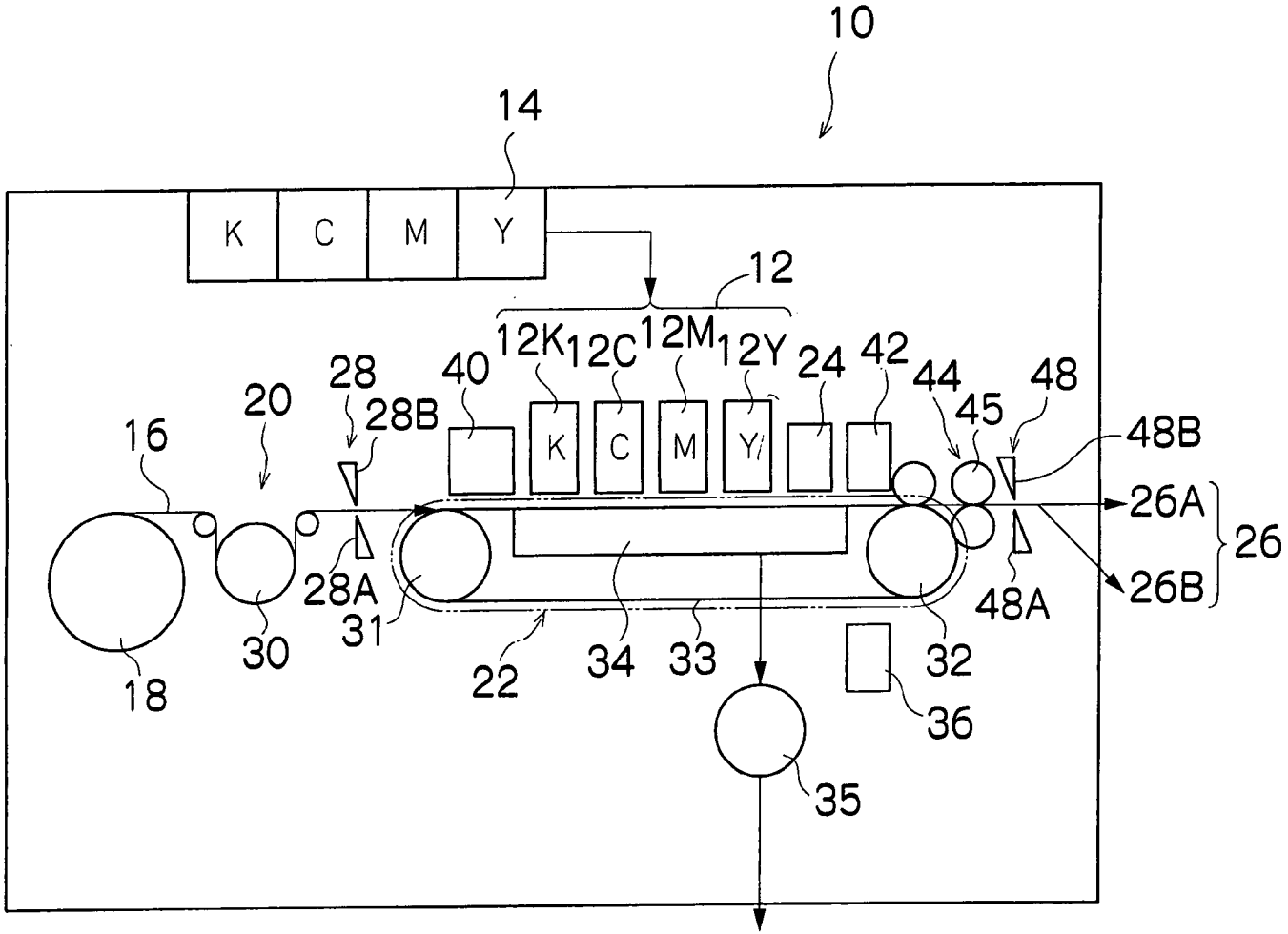
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a line CCD sensor 21 for determining the shape, orientation, and position of the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
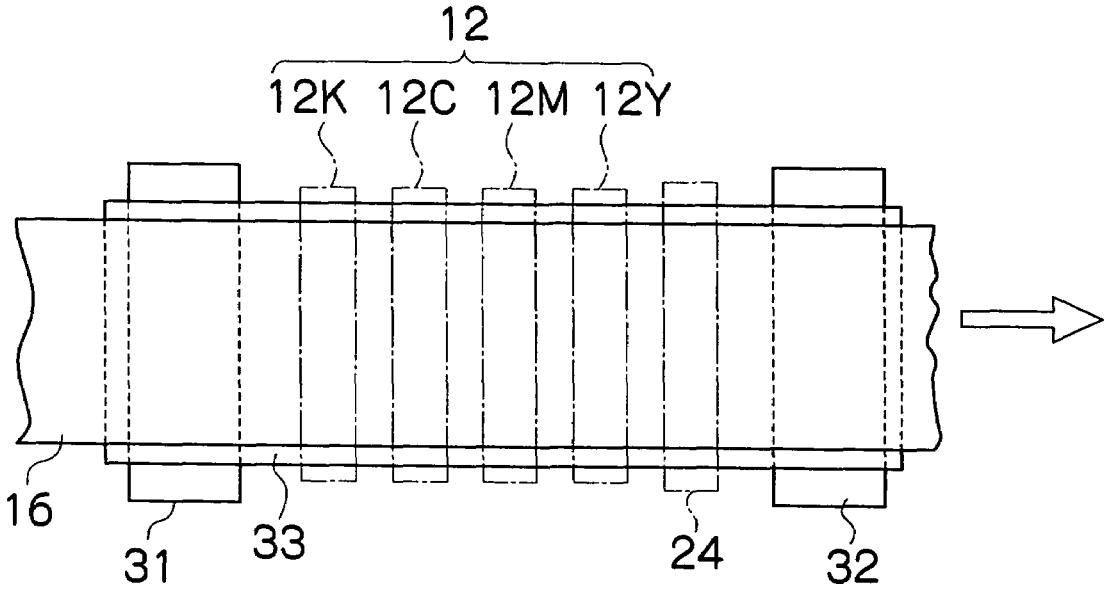
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The ejection determination is described in detail later.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
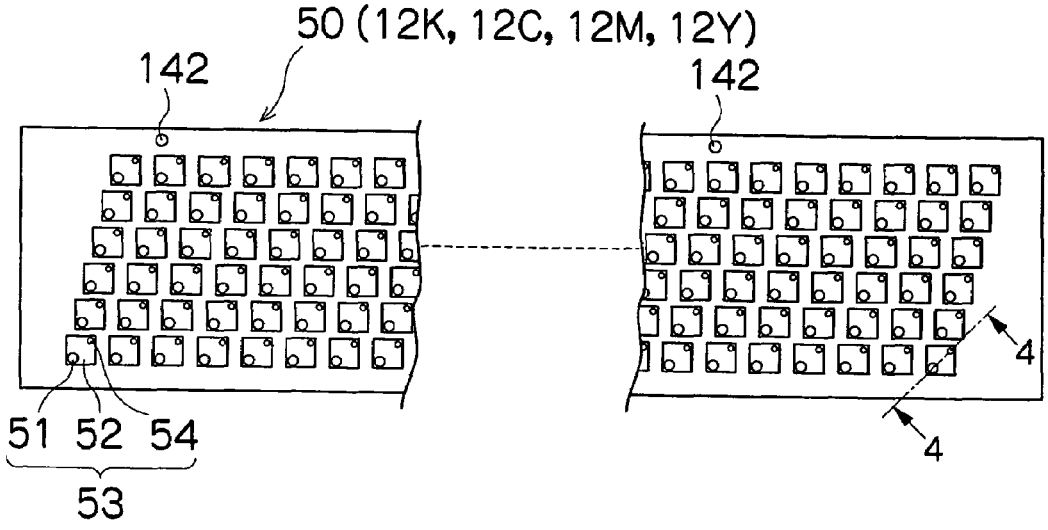
FIG. 3A is a perspective plan view showing an example of a configuration of a print head.
Figure 3B:
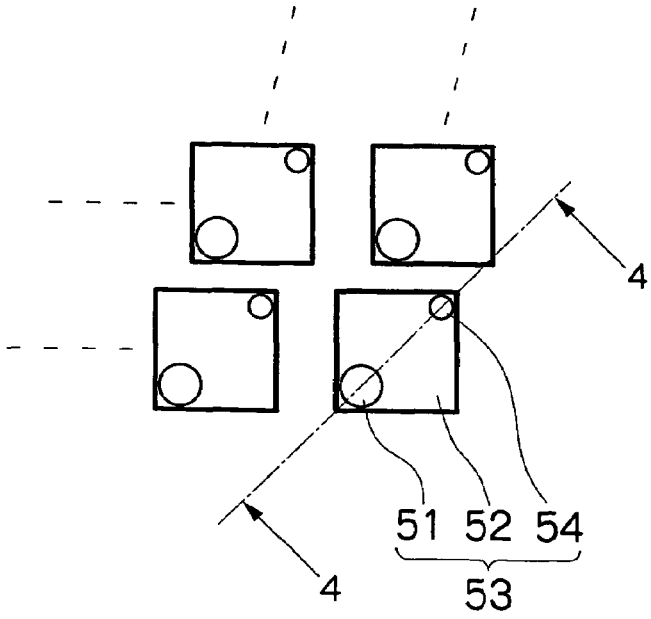
FIG. 3B is a partial enlarged view of FIG. 3A.
Figure 3C:
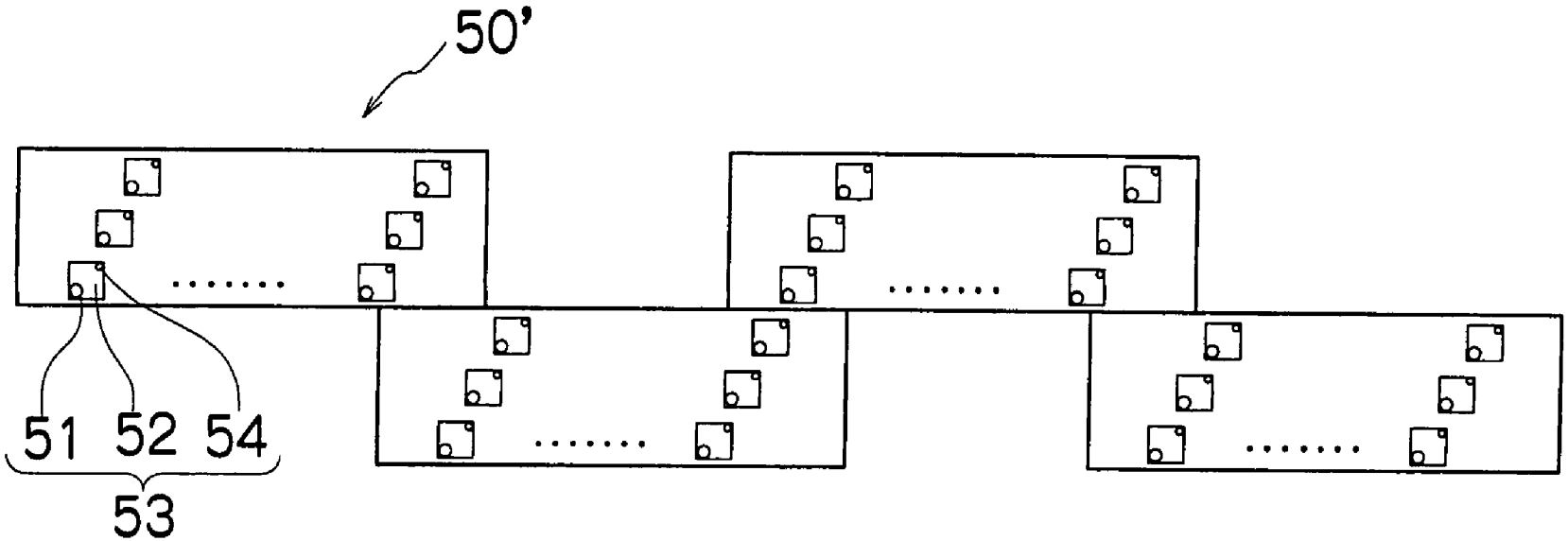
FIG. 3C is a perspective plan view showing another example of the configuration of the print head.
Figure 4:
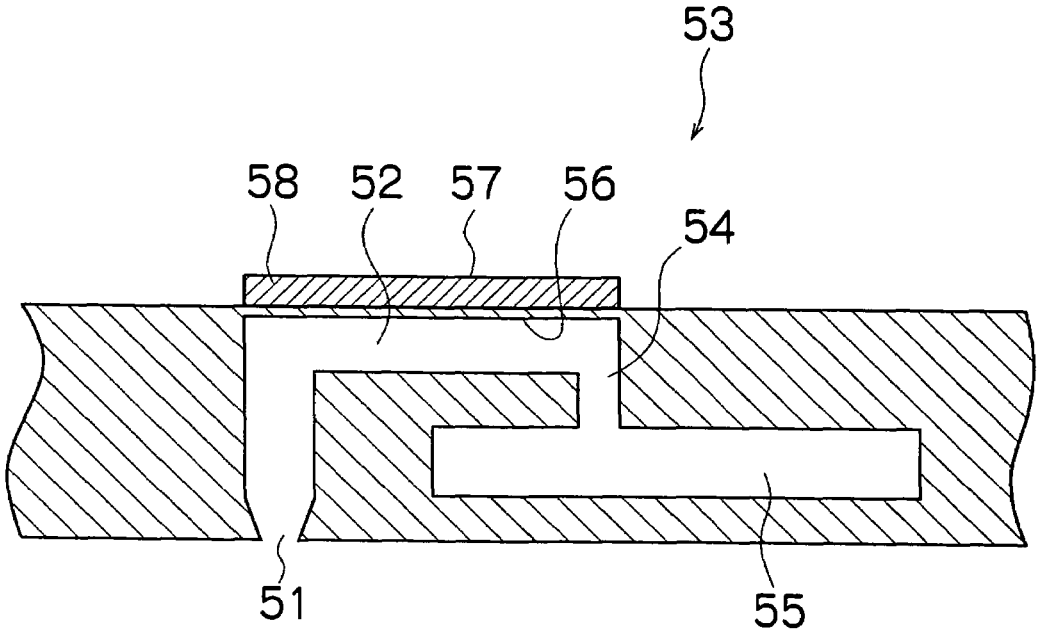
FIG. 4 is a cross-sectional view along a line 4—4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4—4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank, which is a base tank that supplies ink, and the ink supplied from the ink tank is delivered through the common flow channel 55 to the pressure chamber 52.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
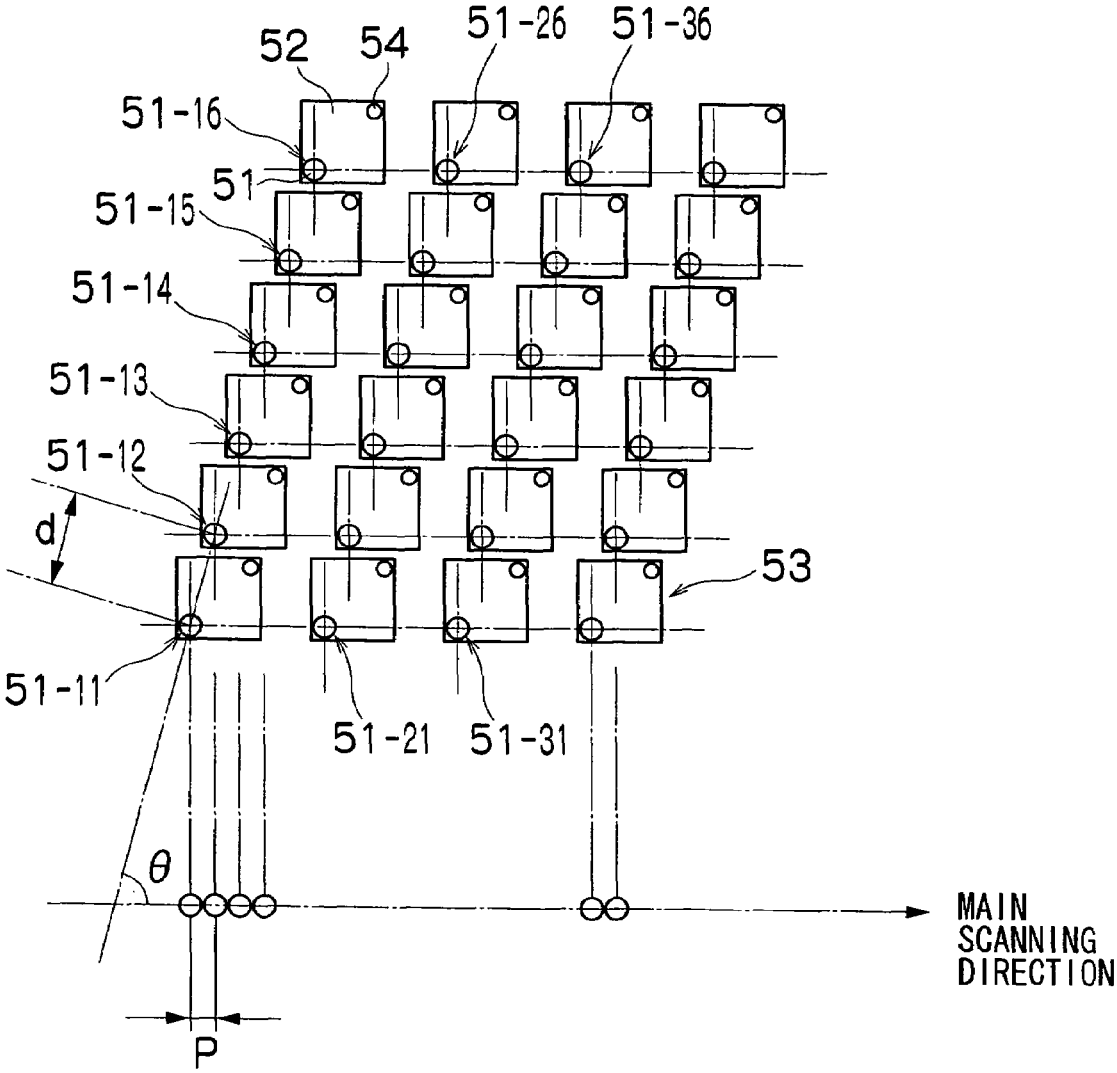
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is d×cos θ.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Figure 6:
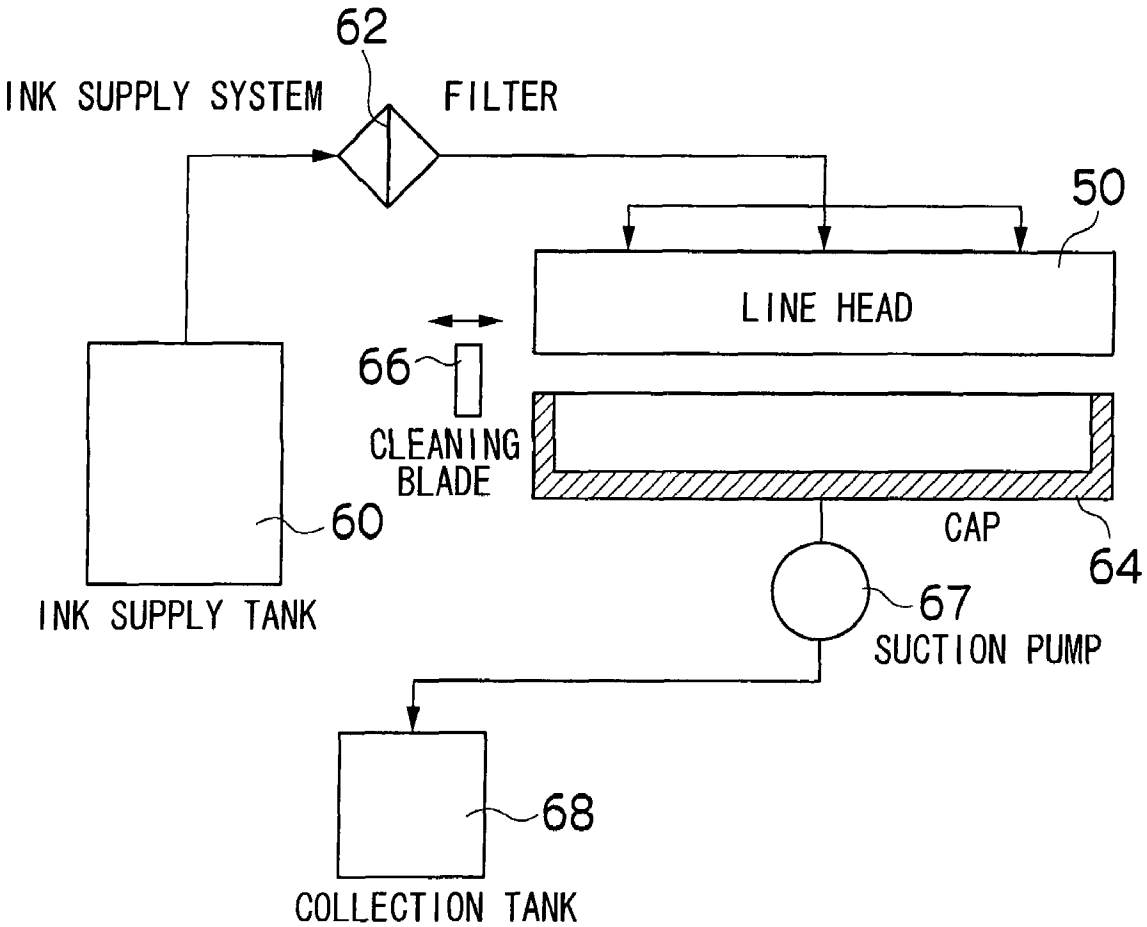
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a maintenance unit 96 (not shown in FIG. 6, but shown in FIG. 7) including a cap 64 as a device to prevent the nozzle 51 from drying out or to prevent an increase in the ink viscosity in the vicinity of the nozzles, and a cleaning blade 66 as a device to clean the ink discharge face of the nozzle 51.

The maintenance unit 96 including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the ink discharge face of the nozzle 51 is thereby covered with the cap 64.

During printing or standby, when the frequency of use of specific nozzles 51 is reduced and a state in which ink is not discharged continues for a certain amount of time or longer, the ink solvent in the vicinity of the nozzle evaporates and ink viscosity increases. In such a state, ink can no longer be discharged from the nozzle 51 even if the actuator 58 is operated.

Before reaching such a state the actuator 58 is operated (in a viscosity range that allows discharge by the operation of the actuator 58), and a preliminary discharge (purge, air discharge, liquid discharge, dummy discharge) is made toward the cap 64 (ink receptor) to which the degraded ink (ink whose viscosity has increased in the vicinity of the nozzle) is to be discharged.

Also, when bubbles have become intermixed in the ink inside the print head 50 (inside the pressure chamber 52), ink can no longer be discharged from the nozzle even if the actuator 58 is operated. The cap 64 is placed on the print head 50 in such a case, ink (ink in which bubbles have become intermixed) inside the pressure chamber 52 is removed by suction with a suction pump 67, and the suction-removed ink is sent to a collection tank 68.

This suction action entails the suctioning of degraded ink whose viscosity has increased (hardened) when initially loaded into the head, or when service has started after a long period of being stopped. The suction action is performed with respect to all the ink in the pressure chamber 52, so the amount of ink consumption is considerable. Therefore, a preferred aspect is one in which a preliminary discharge is performed when the increase in the viscosity of the ink is small.

The cleaning blade 66 is composed of rubber or another elastic member, and can slide on the ink discharge surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 66 on the nozzle plate. When the unwanted matter on the ink discharge surface is cleaned by the blade mechanism, a preliminary discharge is carried out in order to prevent the foreign matter from becoming mixed inside the nozzles 51 by the blade.

Figure 7:
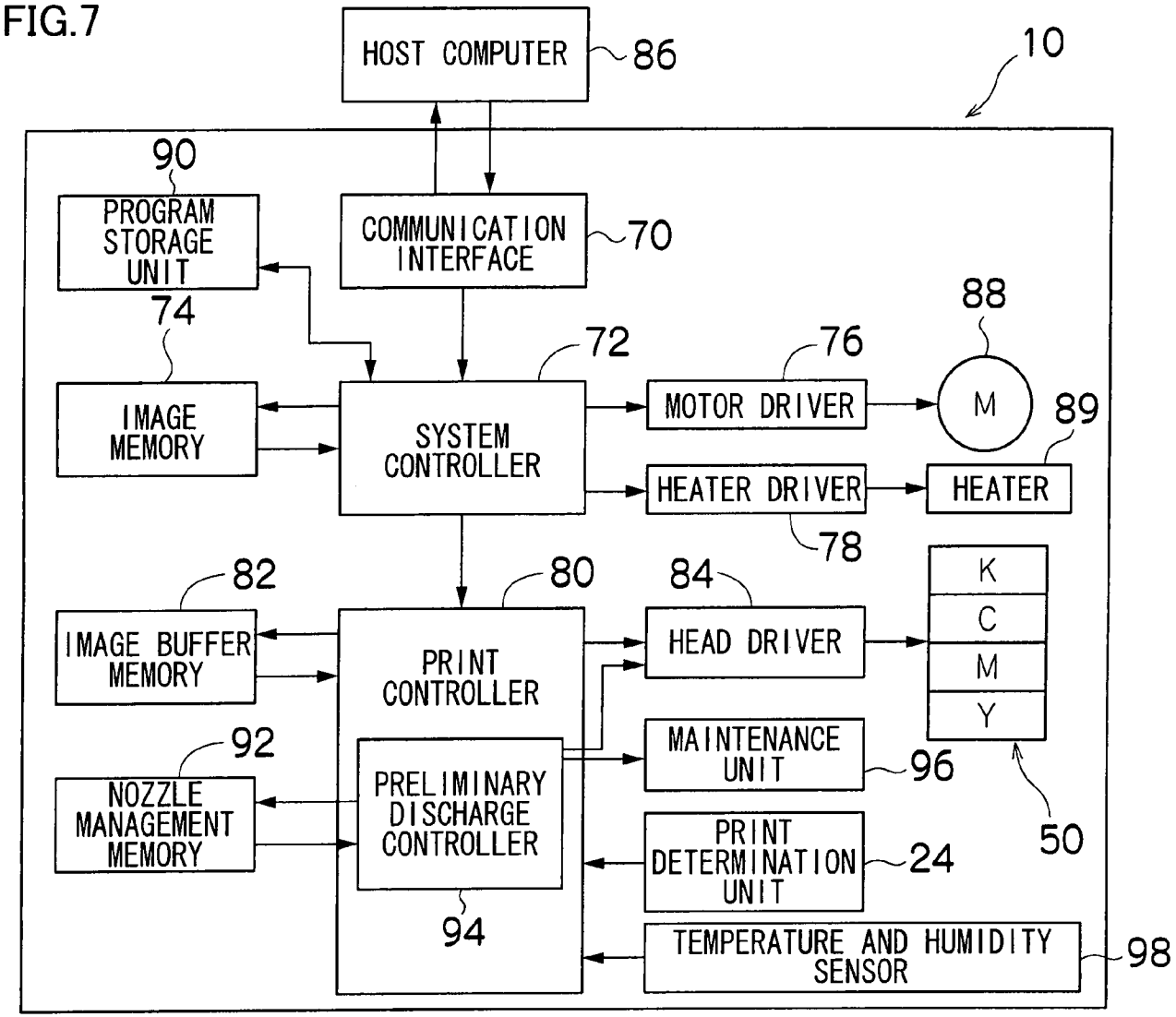
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, a program storage unit 90, a nozzle management memory 92, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

The program storage unit 90 contains various control programs, and each control program is read and carried out according to a command issued by the system controller 72. As the program storage unit 90, a semiconductor memory such as ROM and EEPROM, or a magnetic disk can be used. The program storage unit 90 can have an external interface to use a memory card or a PC card. The program storage unit 90 can be provided with a plurality of types of these storage media.

The program storage unit 90 can also serve as a storage device (not shown) for operational parameters and the like.

The nozzle management memory 92 is a storage device for storing information for managing each of the nozzles 51 in the print head 50. The nozzle management information stored in the nozzle management memory 92 includes: operational time period and non-operational time period of each nozzle (i.e., operational history of each nozzle); predicted operational time period and predicted non-operational time period of each nozzle, which are acquired through the communication interface 70 and the print controller 80 according to the image data (image information) stored in the memory 74 or the image buffer memory 82; a reference time period for performing a preliminary discharge for each nozzle; and so on. Moreover, the nozzle management information stored in the nozzle management memory 92 may further include various other information such as locality information of each nozzle.

The print controller 80 includes a preliminary discharge controller 94, which determines condition of each nozzle according to the nozzle management information stored in the nozzle management memory 92. The preliminary discharge controller 94 outputs prescribed command signals to the head driver 84 and the maintenance unit 96 when deciding that nozzle maintenance action such as preliminary discharge is required.

When making a decision on performance of a nozzle maintenance action, the temperature and humidity inside the inkjet recording apparatus 10, particularly in the vicinity of the print head 50 are important factors. There is a tendency for the increase in the viscosity of the ink to progress more rapidly and for the meniscus surface to dry out more readily, the hotter the temperature in the vicinity of the print head 50. Moreover, there is a tendency for the meniscus surface to dry out more readily, the lower the humidity in the vicinity of the print head 50. Hence, the inkjet recording apparatus 10 is provided with a temperature and humidity sensor 98, which measures the temperature and humidity of parts inside the inkjet recording apparatus 10 and outputs temperature and humidity information to the print controller 80. According to the temperature and humidity information, the preliminary discharge controller 94 in the print controller 80 carries out the control such as changing the reference time period for performing a preliminary discharge.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80.

The print controller 80 makes various compensation with respect to the print head 50 as required on the basis of the information obtained from the print determination unit 24.

In the embodiment shown in FIG. 1, a configuration is adopted in which the print determination unit 24 is disposed on the printed surface side, the printed surface is illuminated by a cold-cathode tube or other light source (not shown) disposed in the vicinity of the line sensor, and the light reflected on the printed surface is read with the line sensor. However, other configurations are also possible in the implementation of the present invention.

Preliminary Discharge Control

In general, in an inkjet recording apparatus, preliminary discharge is carried out at fixed time intervals, in order to prevent discharge errors (unsatisfactory discharges) or discharge failures in the nozzles 51. By carrying out preliminary discharge at fixed time intervals, ink droplets are discharged correctly from the nozzles 51, and hence a prescribed printing quality can be ensured. However, if preliminary discharge is carried out frequently, then the productivity of the actual printing process will fall, and furthermore, ink will be consumed in a wasteful manner.

In order to resolve problems of this kind, control is implemented in such a manner that preliminary discharge is carried out at a preferable timing, in the inkjet recording apparatus 10.

Figure 8:
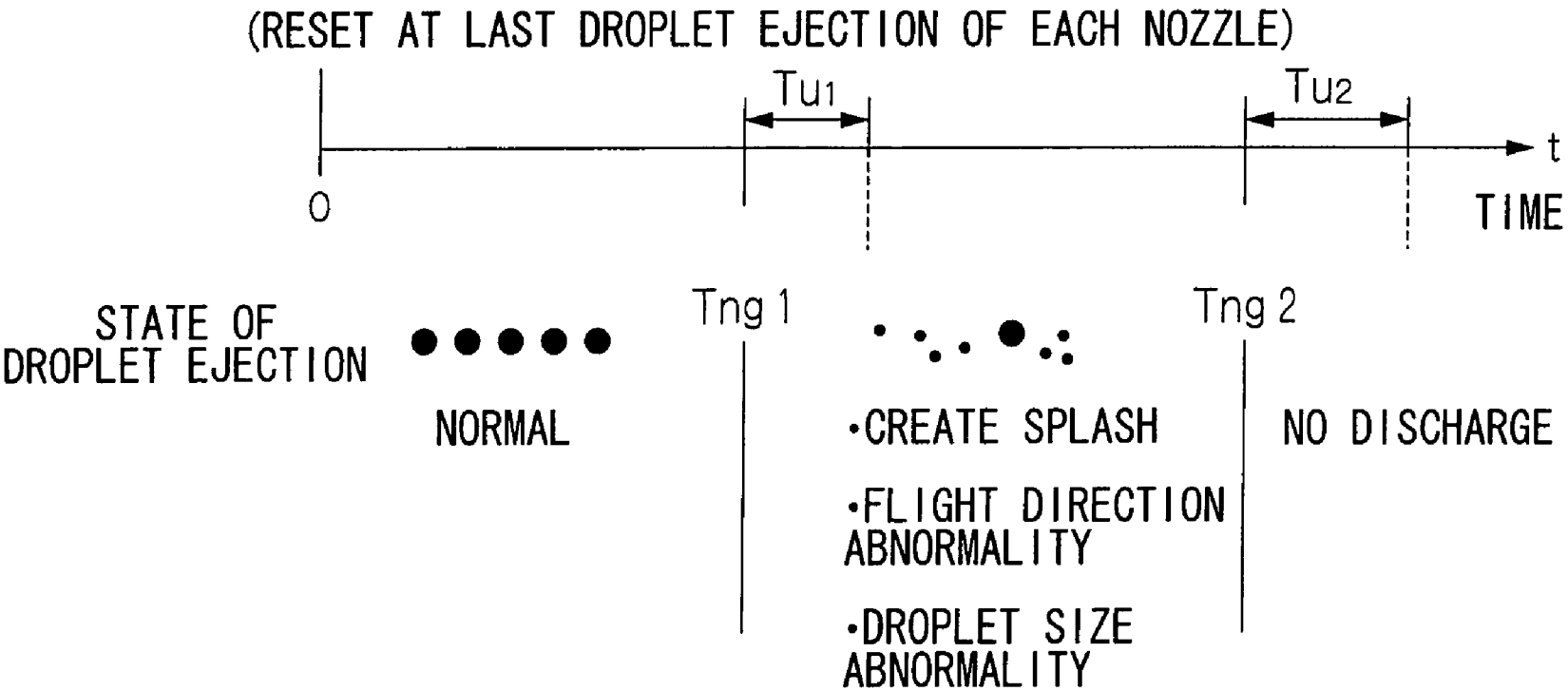
FIG. 8 is a diagram for describing the preliminary discharge reference time period in the inkjet recording apparatus.

FIG. 8 illustrates a preliminary discharge reference time period for the inkjet recording apparatus 10. In the inkjet recording apparatus 10, two parameters are provided in the preliminary discharge reference time period. One of these two parameters is the time period Tng1, which is the time period until discharge abnormalities arise, such as splashes starting to occur when ink inside the nozzles 51 is discharged, or abnormalities starting to occur in the direction of flight (direction of discharge) of the ink droplets, or in the size of the ink droplets (amount of ink discharged). The other parameter is the time period Tng2 until discharge failures arise, wherein ink cannot be discharged from the nozzles 51 under the pressure applied to the ink by driving the actuator 58 shown in FIG. 4.

Here, examples of the judgment references for discharge abnormalities and discharge failures are described below.

Normal droplet ejection is judged to have occurred if the center of the droplet deposition point onto which an ink droplet is actually deposited lies within a distance of 1.5 times or less of the droplet ejection pitch, from the center of the target position (position towards which the droplet is originally ejected), and a discharge abnormality is judged to have occurred if it lies outside this reference.

Furthermore, if a plurality of droplets are deposited and spread over a range of two times or more of the original deposited droplet size, then a discharge abnormality is judged to have occurred, and if no ink at all is discharged from the nozzle 51, then a discharge failure is judged to have occurred. The judgment references for discharge abnormality and discharge failure given above are examples, and it is possible to apply other judgment criteria.

The time periods Tng1 and Tng2 described above are dependent on the type of ink (ink viscosity), the ink batch, the use environment (temperature, humidity, atmospheric pressure) of the print head 50, and the environmental history, and therefore, preferably, a mode is adopted wherein variables are used for these parameters in such a manner that the time periods can be changed according to requirements.

For example, if the intrinsic viscosity of the actual ink is different in different types of ink, then Tng1 and Tng2 are set to smaller values for inks for higher viscosity. It is possible to adopt a composition wherein a radio tag or barcode recording information relating to the ink (the viscosity of the ink) is provided in the ink cartridge, and this ink-related information recorded in the radio tag or barcode is read in when the ink cartridge is replaced, whereby the values of Tng1 and Tng2 can be set by the system controller 72 shown in FIG. 7, on the basis of the ink information read in.

Furthermore, there is a tendency for the increase in the viscosity of the ink to progress more rapidly, the hotter the temperature, and for the meniscus surface to dry out more readily, the lower the humidity. It is also possible to adopt a composition wherein the temperature and humidity can be read in from the temperature and humidity sensor 98 shown in FIG. 7, whereby the values of Tng1 and Tng2 can be set in accordance with the temperature and humidity.

Moreover, it is also possible for the values of Tng1 and Tng2 set in the past to be stored, whereby the average of these values can be determined at a prescribed timing and the settings for Tng1 and Tng2 can be changed on the basis of this average value.

Furthermore, if a piezoelectric element is used for the actuator 58, then before discharge failures occur due to increased viscosity in the ink, it is possible for the ink inside the pressure chamber 52 to be churned by applying slight vibrations to the ink inside the pressure chamber 52 by means of the actuator 58, thereby delaying increase in the viscosity at the meniscus surface (the boundary surface between the ink at the discharge hole of the nozzle 51 and the atmosphere).

The values Tu1 and Tu2 illustrated in FIG. 8 are time periods by which Tng1 and Tng2 can be extended by means of slight vibration of the ink.

The timing at which the slight vibrations are applied may be before the time period exceeds Tng1, or after it exceeds Tng1 but before it exceeds Tng2. Furthermore, the slight vibrations may also be applied at a timing that is independent of the preliminary discharge control. Moreover, preferably, the drive waveform used when applying the slight vibrations to the ink is a rectangular or square waveform. Furthermore, the slight vibrations must also be controlled in such a manner that ink leakages from the nozzle do not occur.

In other words, when the slight vibrations are applied to ink inside the pressure chamber 52, the time period until a discharge abnormality arises will be the total time of Tng1 and Tu1, and the time period until discharge failure arises will be the total time of Tng2 and Tu2. Tu1 and Tu2 are dependent on the type of ink, the ink batch, the use environment, such as the temperature, humidity, atmospheric pressure, and the like, and the environmental history.

If, on the other hand, a thermal type actuator is used, then control for applying slight vibrations to the ink as described above is difficult to achieve, and therefore preliminary discharge is carried out in nearly all cases, in order to deal with increased viscosity in the ink.

Figure 9:
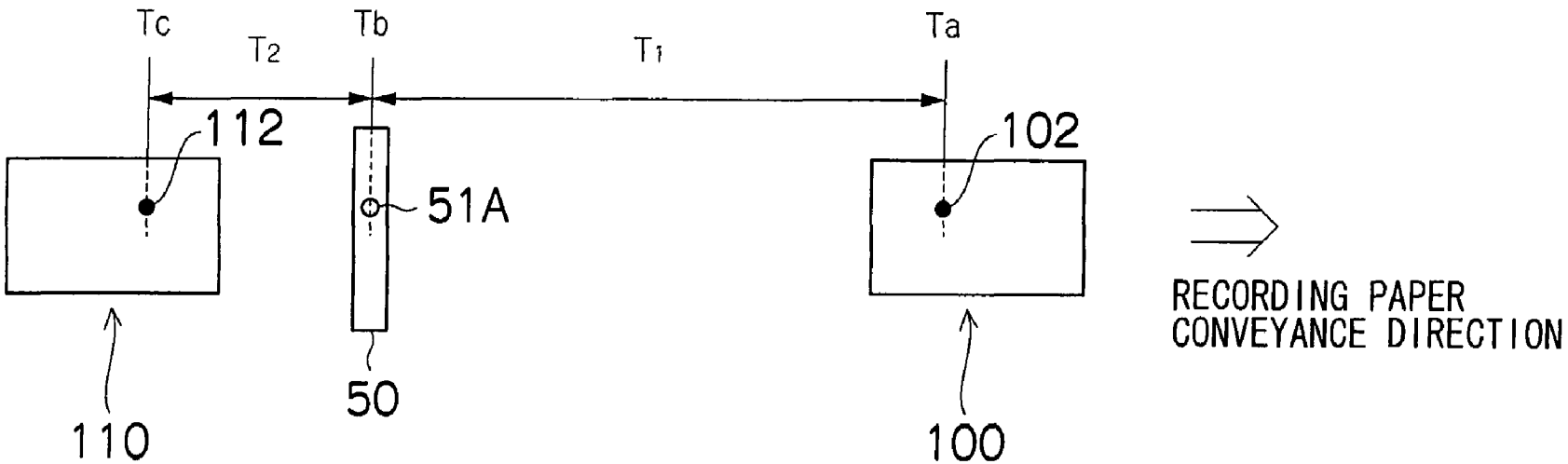
FIG. 9 is a diagram for describing the respective timings of preliminary discharge control in the inkjet recording apparatus.

FIG. 9 illustrates the timing of preliminary discharge control in the inkjet recording apparatus 10. In printing a previous image 100, at timing Ta, a droplet is deposited at a droplet deposition point 102 on the previous image 100, from a certain nozzle 51A in the print head 50.

The preliminary discharge judgment timing Th, after the printing of image 100 has completed until printing of the next image 110 has started, is the timing at which it is judged whether or not to carry out preliminary discharge for the nozzle 51A, and the non-operational time period T1 for the nozzle 51A (the time period from the last timing Ta at which a droplet was ejected from the nozzle 51A, until Tb) is measured (recorded), in addition to which, the predicted non-operational time period T2 from Tb until the timing Tc at which a droplet is deposited at the next droplet deposition point 112 in the next image 110 from the nozzle 51A is also calculated. For example, if the nozzle 51A was operated in the image before last, and it was not operated in the last image, then the non-operational time period T1 will be the time period that has elapsed since the operation of the nozzle 51A two images previously. The waiting time between images (including margin areas) is included in T1 and T2.

The non-operational time period T1 is determined by the system controller 72 and the print controller 80. The nozzle management memory 92 shown in FIG. 7 is used as a memory (storage device) to store the non-operational time period T1 and the predicted non-operational time period T2 temporarily. Furthermore, a memory incorporated into the system controller 72 or another processor may also be used for same.

Moreover, the droplet deposition position on the image for each nozzle is determined from the print data input, and the droplet ejection timing is determined from the conveyance speed of the recording paper, whereby the predicted non-operational time period T2 is established.

If the total time period of the non-operational time period T1 and the predicted non-operational time period T2 for the nozzle 51A measured at timing Tb in FIG. 9 exceeds the preliminary discharge time period Tng1 illustrated in FIG. 8, then at timing Tb in FIG. 9, a preliminary discharge is carried out.

Figure 10:
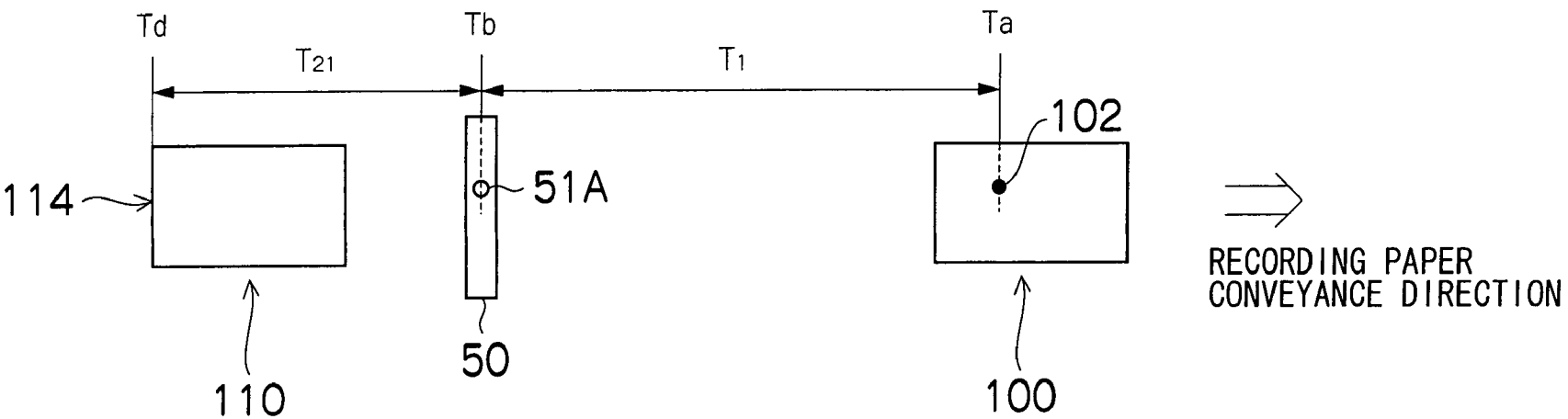
FIG. 10 is a diagram describing the timing of preliminary discharge control in a nozzle which is not operated.

FIG. 10 shows a case where the nozzle 51A is not to be operated (no droplets are to be ejected from the nozzle 51A,) in the next image 110.

In the next image 110, if the nozzle 51A is not to be operated, then the time period T21 from Tb until the print timing Td of the trailing end portion 114 of the next image 110 is calculated. If the sum total of the non-operational time period T1 (having the same definition as T1 described in FIG. 9) and the time period T21 from Tb until the timing Td of printing of the trailing end portion 114 of the next image 110, exceeds the value of Tng2 as illustrated in FIG. 8, then preliminary discharge is carried out at timing Th in FIG. 9.

Figure 11:
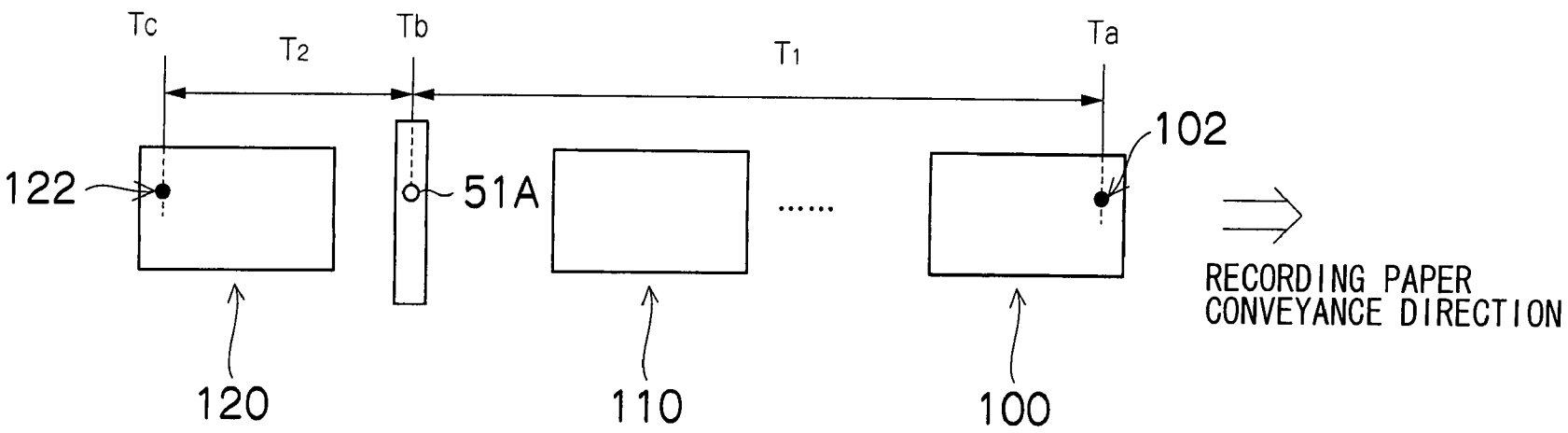
FIG. 11 is a diagram for describing the timing of preliminary discharge control in the case of printing a plurality of images.

Furthermore, if the nozzle 51A is not to be operated in the next image 110, and the total time period of the non-operational time period T1 and the time period T21 until printing of the trailing end portion 114 of the next image 110, without nozzle 51A being used in printing the next image 110, does not exceed Tng2, then as shown in FIG. 11, the calculation (storing) of non-operational time period T1 is continued. Moreover, if the nozzle 51A is to be operated (a droplet is to be deposited at droplet deposition point 122) in printing the next image 120, then non-operational time period T1 and predicted non-operational time period T2 are determined.

When carrying out preliminary discharge, preferably, the discharge pressure is set so as to be higher than in the case of normal discharge (normal printing). By raising the discharge pressure, it is possible to discharge ink of increased viscosity, in an efficient manner.

Figure 12:
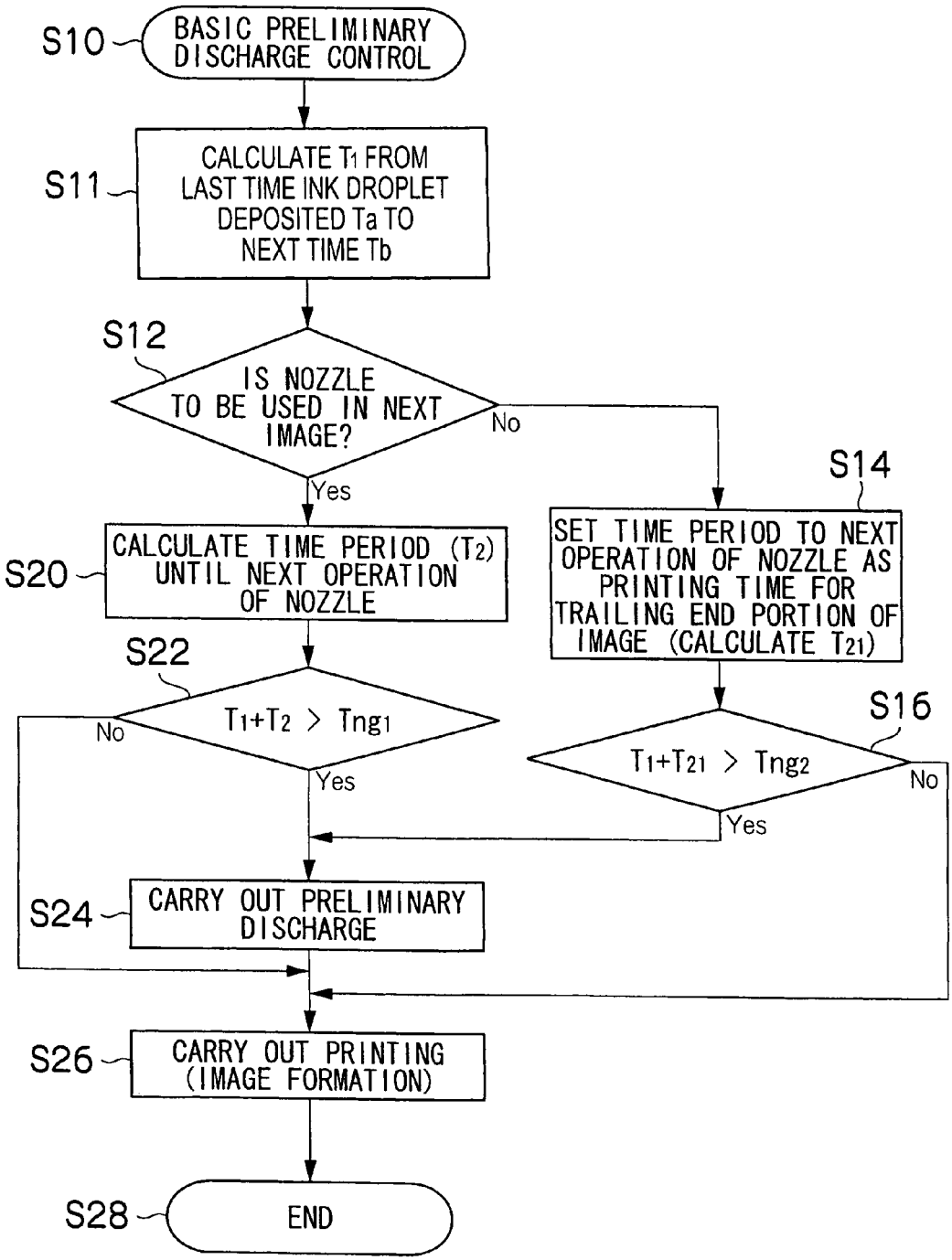
FIG. 12 is a flowchart showing the sequence of preliminary discharge control in the inkjet recording apparatus.

FIG. 12 is a flowchart showing the sequence of preliminary discharge control (normal preliminary discharge control) in the inkjet recording apparatus 10.

When printing is started (step S10), the procedure advances to step S11 to determine T1 and then to step S12, where it is determined whether or not the nozzle 51A is to be used (operated) in the next image. If the nozzle 51A is not to be used in the next image (NO verdict), then the next nozzle operational time period is set as the time period until the trailing end of portion of the image is printed, the time period T21 until printing of the trailing end portion of the image is calculated (step S14), and it is then judged whether or not the total time period of the non-operational time period T1 for the nozzle 51A, plus the time period T21 until printing of the trailing end portion of the image, exceeds the preliminary discharge reference time period Tng2 (step S16).

At step S16, if the total time period of the non-operational time period T1 plus the time period T21 until printing of the trailing end portion of the image does not exceed the value of Tng2 indicated in FIG. 8 (NO verdict), then printing (image formation) is carried out (step S26 in FIG. 12), whereas if the total time period of the non-operational time period T1 plus the time period T21 until printing of the trailing end portion of the image does exceed the value of the preliminary discharge reference time period Tng2 (YES verdict), then preliminary discharge is carried out (step S24).

If preliminary discharge is carried out at step S24, the non-operational time period T1 is reset (initialized) (namely, it is set to T1=0), and the procedure advances to step S26, wherein printing is carried out.

If the prescribed printing process has been carried out at step S26, the procedure advances to step S28, wherein preliminary discharge control terminates. If the nozzle in question is operated in this printing process, then T1 is reset.

On the other hand, at step S12, if nozzle 51A is to be used in the next image (YES verdict), then the time period until the nozzle 51A is next used (predicted non-operational time period) T2 is calculated (step S20), and it is judged whether or not the total time period of the non-operational time period T1 plus the predicted non-operational time period T2 for the nozzle 51A exceeds the value of Tng1 as shown in FIG. 8 (step S22 in FIG. 12).

At step S22, if the total time period of the non-operational time period T1 plus the predicted non-operational time period T2 for the nozzle 51A does not exceed Tng1 (NO verdict), then printing is carried out (step S26), whereas if the total time period of the non-operational time period T1 plus the predicted non-operational time period T2 for the nozzle 51A does exceed Tng1 (YES verdict), then the procedure advances to step S24, and preliminary discharge is carried out.

In the present embodiment, a case is described wherein the timing Tb is before the printing of the next image, but it is also possible for it to be before the start of printing of each batch. Moreover, in the case of a batch which involves a long printing time (a large-volume print operation, or the like), it can be judged whether or not to carry out preliminary discharge at a suitable timing during the batch.

As described above, the values of T1, T2 and T21 are managed independently for each nozzle, by the print controller 80 shown in FIG. 7, are stored as and when necessary in the nozzle management memory 92, and are compared with Tng1 and Tng2 by the preliminary discharge controller 94 to control preliminary discharge. Therefore, data is managed for each one of the nozzles in the head.

Figure 13:
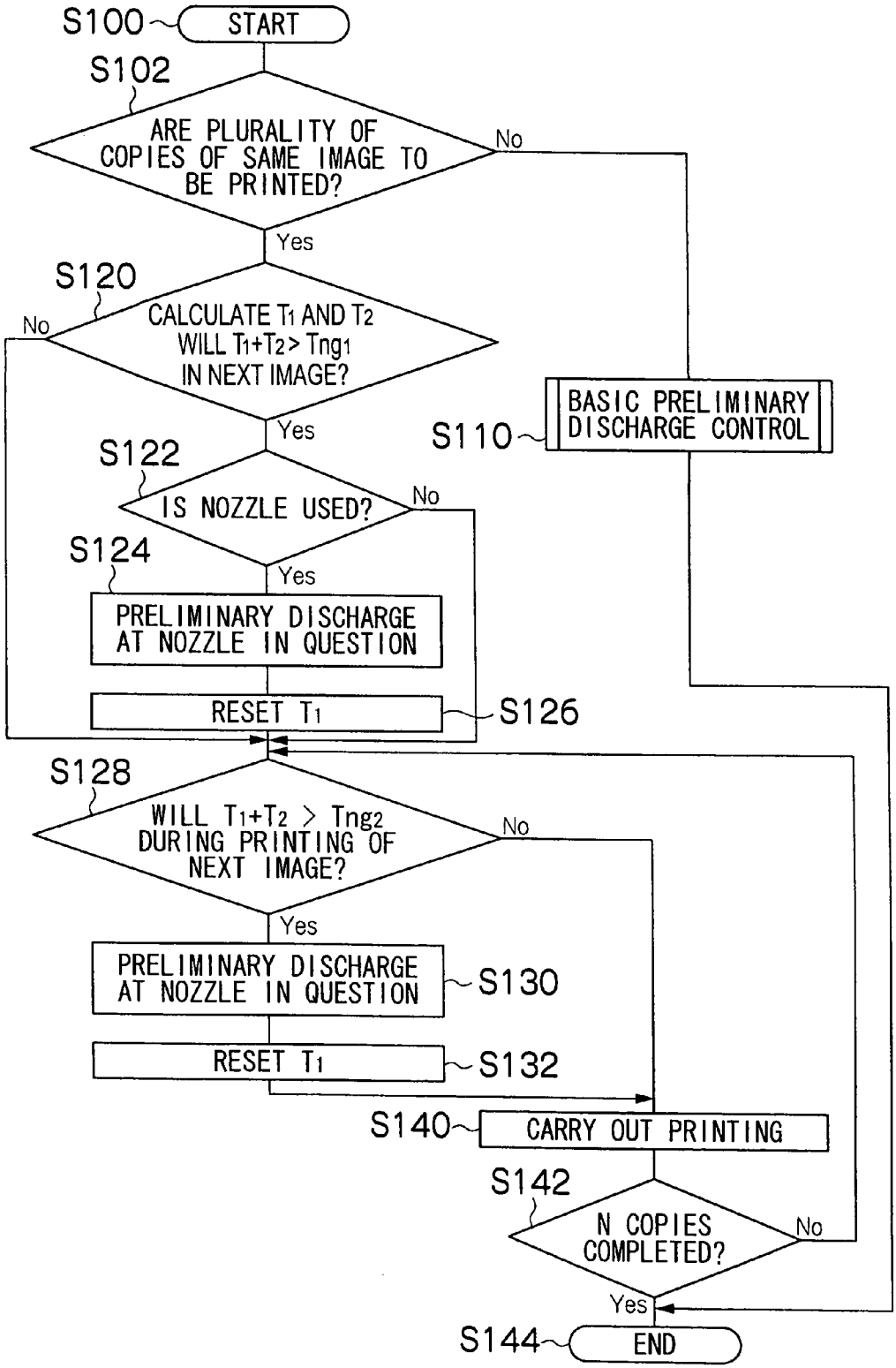
FIG. 13 is a flowchart showing the sequence of preliminary discharge control in the case of printing a plurality of images of the same content.

Next, the control of preliminary discharge in the case of printing a plurality of images having the same content will be described with reference to FIG. 13. In FIG. 13, items which are the same as or similar to those in FIG. 12 are labeled with the same reference numerals and description thereof is omitted here.

When printing a plurality of copies of the same image, since the nozzles that are to be operated and the nozzles that are not to be operated are established, then in the nozzles that are operated, preliminary discharge is carried out with reference to Tng1 as illustrated in FIG. 8, and in the nozzles that are not operated, preliminary discharge is carried out if the time until the completion of the next image exceeds Tng2 illustrated in FIG. 8, thereby preventing complete discharge failure in the nozzles. When printing a plurality of copies of the same image, it may also happen that preliminary discharge is not carried out, depending on the length of the printed image and the number of copies printed.

When printing starts (step S100), the procedure advances to step S102, the total time period of the non-operational time period T1 plus the predicted non-operational time period T2 illustrated in FIG. 9 is calculated, and it is judged whether or not a plurality of copies of the same image are being printed.

If a plurality of copies of the same image are not to be printed (NO verdict), then the normal preliminary discharge control illustrated in FIG. 12 is carried out (step S110), and when the control in step S110 is terminated, then the procedure advances to step S144, and the preliminary discharge control is terminated.

Furthermore, in step S102, if it is judged that a plurality of copies of the same image are to be printed (YES verdict), then the procedure advances to step S120, the total time period of the non-operational time period T1 and the predicted non-operational time period T2 illustrated in FIG. 9 are calculated, and it is judged whether or not the total time period in the next image exceeds Tng1 as illustrated in FIG. 8.

At step S120 in FIG. 13, if it is judged that the total time period at the next image will not exceed, Tng1, then the procedure advances to step S128, and during printing, it is judged whether or not the total time period of the non-operational time period T1 and the predicted non-operational time period T2 exceed the value of Tng2 illustrated in FIG. 8.

At step S128, if the total time period does not exceed Tng2 (NO verdict), then printing is carried out (step S140), and the procedure advances to step S142, where it is judged whether or not printing of a prescribed number of copies (N copies) has been completed. If printing of N copies has not been completed (NO verdict), then the procedure advances to step S128, and if printing of N copies has been completed (YES verdict), then the preliminary discharge control is terminated (step S144).

On the other hand, if, at step S128, the total time period exceeds Tng2 (YES verdict), then preliminary discharge is carried out for the nozzle in question (step S130), and after resetting the value of non-operational time period T1 (step S132), the procedure advances to step S140.

At step S120, if it is judged that the total time period will exceed Tng1 in the next image, then the procedure advances to step S122, it is judged whether or not the nozzle in question is a nozzle that is to be operated (a nozzle in use). If, at step S122, the nozzle is not a nozzle that is to be operated (NO verdict), then the procedure advances to step S128, and if it is a nozzle that is to be operated (YES verdict), then preliminary discharge of the nozzle is carried out (step S124), T1 is reset (step S126), and the procedure advances to step S128.

In the case of a print of long dimensions, or the like, preferably, control is performed in such a manner that there are no discharge abnormalities in operating nozzles, from the second print onwards.

In an inkjet recording apparatus 10 having a composition of this kind, the time period Tng1 until discharge abnormalities occur, and the time period Tng2 until discharge failures occur are provided as judgment reference time periods for judging whether or not to carry out preliminary discharge, and control is performed in such a manner that preliminary discharge is carried out on the basis of these judgment reference time periods. More specifically, since two time parameters until preliminary discharge is carried out are provided, then it is possible to prevent discharge abnormalities and discharge failures, and furthermore, the amount of ink consumed can be restricted.

Furthermore, for each nozzle, the non-operational time period T1 from the last time of operation, and the predicted non-operational time period T2 until the next time of operation, are calculated, and if the total time period of non-operational time period T1 plus predicted non-operational time period T2 exceeds Tng1, then preliminary discharge is carried out. In a nozzle that is not to be operated in the next image, the time period T21 until the trailing end portion of the image is printed is calculated, and if the total time period of the non-operational time period T1 plus the time period T21 until printing of the trailing end portion of the image exceeds Tng2, then preliminary discharge is carried out.

Before printing, it is judged whether or not the preliminary discharge limit time (the time period for which normal discharge can be achieved without performing preliminary discharge) will be exceeded during the next printing operation, and consequently, the occurrence of discharge abnormalities during printing can be prevented, while at the same time, nozzles that are not to be operated can be prevented from developing discharge failures.

The foregoing is an example wherein the non-operational time period T1, the predicted non-operational time period T2, and the time period T21 until printing of the trailing portion of the image, are controlled on an individual basis for each nozzle.

On the other hand, it is also possible to perform control in such a manner that a plurality of nozzles are treated as a single block. For example, a line head having 10,000 nozzles for each color is divided into 100 blocks, and preliminary discharge is controlled for the 100 nozzles in one block, together.

In this case, the non-operational time period T1 is counted up by taking as a reference the first timing at which one of the nozzles in the block in question was driven in the previous image. For the predicted non-operational time period T2, a predicted time period until the last time at which one of all the nozzles inside the block in question is to be driven, is input. Furthermore, if discharge prediction is not carried out for all the nozzles in the block in question, in the next image, then the time period T21 until printing the trailing end portion of the next time is used.

In this way, printing errors (droplet size errors, flight direction errors) are avoided by setting T1, T2 and T21 to the strictest conditions for each block, and hence the load on the control system and the memory can be reduced. Moreover, it is also possible to control preliminary discharge by setting T1, T2 and T21 to the strictest conditions with respect to the whole print head.

In the present embodiment, an example of control is illustrated wherein the judgment of whether or not to carry out preliminary discharge is made for each print (image), but it is also possible to implement control wherein the judgment of whether or not to carry out preliminary discharge is made respectively for each plurality of prints.

In the present embodiment, a full line type print head was described, but the scope of the present invention is not limited to this, and hence it may also be applied to a shuttle scanning type print head. Conventionally, in a shuttle scan type print head, preliminary discharge is performed in all of the nozzles, compulsorily, at fixed time intervals, but it is also possible to perform control by judging whether or not the preliminary discharge reference time period is to be exceeded before starting the next scan, in such a manner that preliminary discharge is carried out selectively, at certain nozzles only.

Furthermore, in the present embodiment, a piezo method using a piezoelectric element in order to discharge ink droplets was described, but the present invention may also be applied to a thermal type inkjet recording apparatus, wherein an energy generating body is provided in a pressure chamber, and ink is discharged by means of a bubble generated by heating the ink inside the pressure chamber, by means of an energy generating body.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a recording head including nozzles which discharge ink droplets onto a recording medium for printing;

a computing device which computes a non-operational time period for one of the nozzles;

a calculating device which calculates a predicted non-operational time period until a next operation of the one of the nozzles; and a preliminary discharge control device which performs control whereby preliminary discharge of the one of the nozzles is carried out if a total of the non-operational time period and the predicted non-operational time period exceeds a reference time period.

2. The inkjet recording apparatus as defined in claim 1, wherein the reference time period is a time period until discharge abnormality in the ink-droplets discharged from the nozzles occurs.

3. The inkjet recording apparatus as defined in claim 1, wherein the reference time period is determined in accordance with at least one of a type of ink and use environmental conditions of the recording head.

4. An inkjet recording apparatus, comprising:

a recording head including nozzles which discharge ink droplets onto a recording medium for printing;

a computing device which computes a non-operational time period for the nozzles;

a calculating device which calculates a predicted non-operational time period until a next operation of the nozzles; and a preliminary discharge control device which performs control whereby:

in one of the nozzles to be operated in a next image, preliminary discharge of the nozzle is carried out if a total of the non-operational time period and the predicted non-operational time period exceeds a first reference time period; and in one of the nozzles not to be operated in the next image, a prescribed time period is set as the predicted non-operational time period, and preliminary discharge of the nozzle is carried out if a total of the non-operational time period and the prescribed time period exceeds a second reference time period.

5. The inkjet recording apparatus as defined in claim 4, wherein the preliminary discharge control device performs control in a case where a plurality of prints of a same image are to be executed whereby:

in one of the nozzles to be operated, preliminary discharge of the nozzle is carried out when a first one of the plurality of prints is executed if the total of the non-operational time period and the predicted non-operational time period exceeds the first reference time period; and in one of the nozzles not to be operated, preliminary discharge of the nozzle is carried out when each of the plurality of prints is executed if a total of the non-operational time period and a time period until printing of a trailing end portion of the next print is completed exceeds the second reference time period during printing of the next print.

6. The inkjet recording apparatus as defined in claim 4, wherein the first reference time period is a time period until discharge abnormality in the ink-droplets discharged from the nozzles occurs.

7. The inkjet recording apparatus as defined in claim 4, wherein the second reference time period is a time period until discharge failure occurs whereby ink is not discharged from the nozzles by prescribed driving.

8. The inkjet recording apparatus as defined in claim 4, wherein each of the first reference time period and the second reference time period is determined in accordance with at least one of a type of ink and use environmental conditions of the recording head.

9. An inkjet recording apparatus, comprising:

a recording head including nozzles which discharge ink droplets onto a recording medium for printing;

a computing device which computes a non-operational time period for the nozzle;

a calculating device which calculates a predicted non-operational time period until a next operation of the nozzle; and a preliminary discharge control device which performs control whereby:

in one of the nozzles to be operated in a next image, preliminary discharge of the nozzle is carried out when a total of the non-operational time period and the predicted non-operational time period exceeds a first reference time period; and in one of the nozzles not to be operated in the next image, preliminary discharge of the nozzle is carried out when a total of the non-operational time period and a time period from a current time until printing of a trailing end portion of the next image has completed, exceeds a second reference time period.

10. The inkjet recording apparatus as defined in claim 9, wherein the preliminary discharge control device performs control in a case where a plurality of prints of a same image are to be executed whereby:

in one of the nozzles to be operated, preliminary discharge of the nozzle is carried out when a first one of the plurality of prints is executed if the total of the non-operational time period and the predicted non-operational time period exceeds the first reference time period; and in one of the nozzles not to be operated, preliminary discharge of the nozzle is carried out when each of the plurality of prints is executed if a total of the non-operational time period and a time period until printing of the trailing end portion of the next print is completed exceeds the second reference time period during printing of the next print.

11. The inkjet recording apparatus as defined in claim 9, wherein the first reference time period is a time period until discharge abnormality in the ink-droplets discharged from the nozzles occurs.

12. The inkjet recording apparatus as defined in claim 9, wherein the second reference time period is a time period until discharge failure occurs whereby ink is not discharged from the nozzles by prescribed driving.

13. The inkjet recording apparatus as defined in claim 9, wherein each of the first reference time period and the second reference time period is determined in accordance with at least one of a type of ink and use environmental conditions of the recording head.

14. A preliminary discharge control method for an inkjet recording apparatus comprising a recording head including nozzles which discharge ink droplets onto a recording medium for printing, the method comprising:

a computing step of computing a non-operational time period for one of the nozzles;

a calculating step of calculating a predicted non-operational time period until a next operation of the one of the nozzles; and a preliminary discharge step of carrying out preliminary discharge of the one of the nozzles, by means of a preliminary discharge control device which controls preliminary discharge, if a total of the non-operational time period computed in the computing step and the predicted non-operational time period calculated in the calculating step, exceeds a reference time period.

15. A preliminary discharge control method for an inkjet recording apparatus comprising a recording head including nozzles which discharge ink droplets onto a recording medium for printing, the method comprising:

a computing step of computing a non-operational time period for one of the nozzles;

a calculating step of calculating a predicted non-operational time period until a next operation of the one of the nozzles; and a preliminary discharge step of carrying out preliminary discharge by means of a preliminary discharge control device for controlling preliminary discharge whereby:

in one of the nozzles to be operated in a next image, preliminary discharge of the nozzle is carried out if a total of the non-operational time period and the predicted non-operational time period exceeds a first reference time period; and in one of the nozzles not to be operated in the next image, a prescribed time period is set as the predicted non-operational time period, and preliminary discharge of the nozzle is carried out if a total of the non-operational time period and the prescribed time period exceeds a second reference time period.

16. A preliminary discharge control method for an inkjet recording apparatus comprising a recording head including nozzles which discharge ink droplets onto a recording medium for printing, the method comprising:

a computing step of computing a non-operational time period for one of the nozzles;

a calculating step of calculating a predicted non-operational time period until a next operation of the one of the nozzles; and a preliminary discharge step of carrying out preliminary discharge by means of a preliminary discharge control device for controlling preliminary discharge whereby:

in one of the nozzles to be operated in a next image, preliminary discharge of the nozzle is carried out when a total of the non-operational time period and the predicted non-operational time period exceeds a first reference time period; and in one of the nozzles not to be operated in the next image, preliminary discharge of the nozzle is carried out when a total of the non-operational time period and a time period from a current time until printing of a trailing end portion of the next image has completed, exceeds a second reference time period.

* * * * *